United States Patent [19]

Ross et al.

[11] 4,393,930

[45] Jul. 19, 1983

[54] SUBTERRANEAN WELL PRESSURE SURGING TOOL

[75] Inventors: Richard J. Ross; Luis E. Mendez, both of Houston, Tex.

[73] Assignee: Baker International Corporation, Orange, Calif.

[21] Appl. No.: 244,997

[22] Filed: Mar. 18, 1981

[51] Int. Cl.[3] ..... E21B 37/08

[52] U.S. Cl. ..... 166/188; 166/312; 166/317

[58] Field of Search ..... 166/106, 165, 188, 317, 166/312, 323; 175/234, 235, 242

[56] References Cited

U.S. PATENT DOCUMENTS

| | | | |
|---|---|---|---|
| 2,401,871 | 6/1946 | Heeter | 166/165 |
| 4,154,303 | 5/1979 | Fournier | 166/317 |
| 4,160,484 | 7/1979 | Watkins | 166/323 X |
| 4,185,690 | 1/1980 | Kinney | 166/188 X |

*Primary Examiner*—Ernest R. Purser
*Attorney, Agent, or Firm*—W. C. Norvell, Jr.

[57] ABSTRACT

An apparatus is provided for accomplishing pressure surging operations to remove particulates from the casing perforations and formation face of a subterranean well production zone. The apparatus includes two normally closed valve assemblies separated by a surge chamber maintained at atmospheric pressure. The uppermost valve assembly is connected to the end of a tubing string. A packer secures the lower valve assembly in sealing relationship to the casing bore. The lower valve assembly incorporates means for opening a flapper valve disposed between the atmospheric pressure surge chamber and the open bottom bore of the lower valve assembly. Such flapper valve is shiftable to an open position by movement of an actuator which responds to an increase in annulus fluid pressure. The opening of the flapper valve in the lower valve assembly produces a surge of production fluid from the formation and through the casing perforations into the atmospheric pressure surge chamber. The freed particulate matter is removed from the well by pressure actuation of an actuator sleeve in the upper valve assembly which moves upwardly to permit a spring-biased flapper valve to move to an open position. Thereafter, the packer is released from sealing engagement with the casing and fluid is pumped in a reverse circulation path downwardly through the casing annulus and around the valve assemblies and the interconnected surge chamber and then upwardly to the top of the well through the tubing string.

8 Claims, 8 Drawing Figures

SUBTERRANEAN WELL PRESSURE SURGING TOOL

BACKGROUND OF THE INVENTION

1. Field of the Invention

The invention relates to a tool utilized to remove particulate matter from perforations immediate formations in a subterranean well.

2. Description of the Prior Art

During the flow of production fluid into a well casing or while injecting secondary or tertiary recovery fluids into the formation, perforations in the well casing or the face of the producing formation may oftentimes become plugged with sand, silt, or other substances, restricting fluid flow between the formation of the casing bore. Heretofore, it has been common practice to utilize a valve apparatus which creates a high pressure differential to produce a sudden high velocity flow or surge of the formation fluid through the perforations and into the casing bore, thereby carrying sand, silt, and the like, into the tubing for subsequent elevation to the top of the well. As a result, the formation and perforations are washed or cleared, facilitating subsequent well production or the injection of secondary or tertiary recovery fluids into the formation.

Some of the prior art backsurge valving assemblies require drill or work string rotation to manipulate one or more of the valves. Such mechanically-activated manipulations may be undesirable in deviated holes and/or in wells of extreme depth. Moreover, some valving assemblies heretofore utilized in backsurge systems incorporate a diaphragm or disk-like element as a valve head which is ruptured by pressure, or is "cut" to open the valve, thus possible contributing to foreign particulate matter in the well which also could adversely affect subsequent operation of the valve assembly by becoming jammed between two moving parts.

Backsurge well-cleaning tools are known which are activated by pressure, one such tool being shown in U.S. Pat. No. 4,185,690, issued on Jan. 29, 1980 to the assignee of the present application. As disclosed therein, the backsurge tool generally comprises a tubing string having an upper normally closed valve communicating with a lower normally closed valve through an atmospheric pressure chamber. Although this backsurge well-cleaning tool is similar to the cleaning tool of the present invention in that it is activated by pressure, it includes a valve assembly having a blanking plug.

SUMMARY OF THE INVENTION

The backsurge well-cleaning tool of the present invention generally comprises first (lower) and second (upper) valve assemblies interconnected by a surge chamber at atmospheric pressure and includes a conventional packer extending to the first valve assembly. The backsurge tool is adapted to be run into a well on a tubing string with both valves closed. Initially the packer is set to isolate the annulus between the backsurge tool and the well formation. The lower valve assembly then is opened, thus communicating the well formation and the surge chamber. This action produces a vacuum-like action to pull a surge of fluid into the surge chamber and thus remove debris from the formation and the well casing perforations. The upper valve is then opened for producing a reverse circulation of the well fluid in the surge chamber containing the dislodged debris. Concurrently, the packer is released and fluid pressure applied through the tubing-casing annulus and debris containing fluid passes upwardly through the open valve assemblies.

The upper valve assembly has a body which is connected to the tubing string. The operative valving element is a flapper valve mounted in the lower portion of the body. The upper valve assembly also includes a longitudinally movable, actuating sleeve carrying a valve seat at its lowermost end for selective sealing engagement with the flapper valve. The actuating sleeve is normally retained in its valve closing position by a segmented locking ring. A longitudinally movable, segment retainer sleeve mounted in the valve body is responsive to pressurization of tubing fluid to release the segmented locking ring, allowing the actuating sleeve to be shifted away from the flapper valve by fluid pressure. The flapper valve is thus opened by a torsion spring to allow fluid flow through the valve assembly.

DESCRIPTION OF THE PREFERRED EMBODIMENTS

Figure 1A:
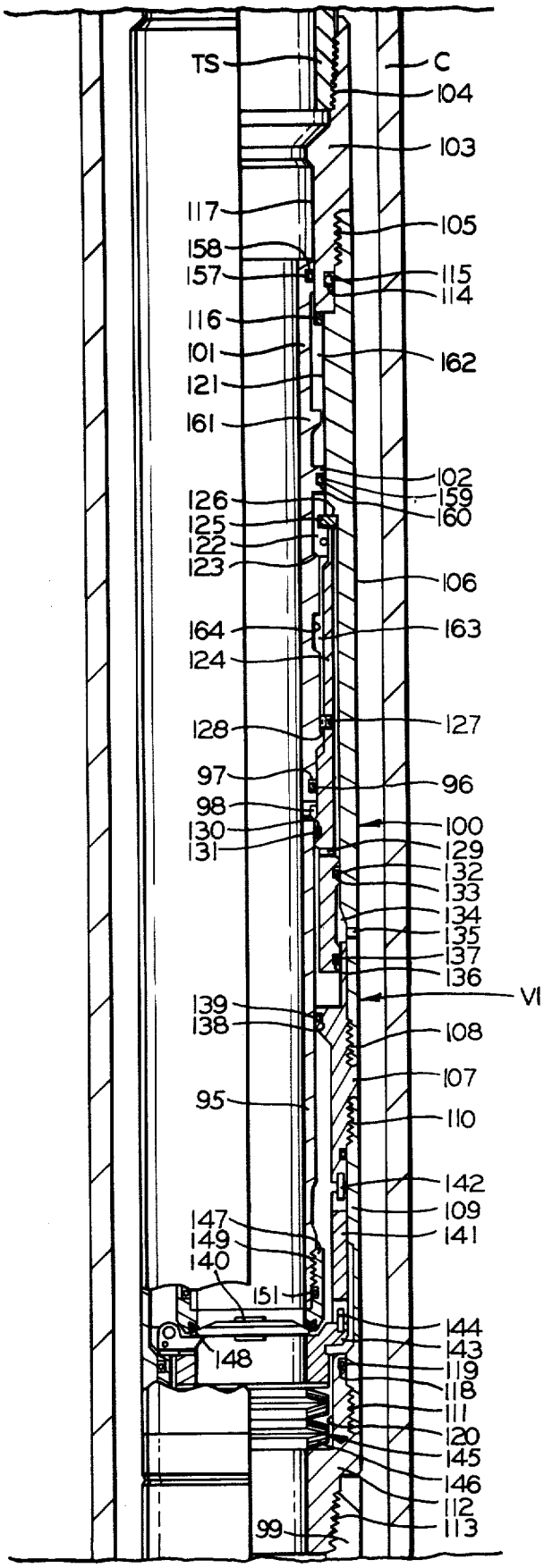
FIGS. 1A, 1B and 1C together constitute a longitudinal schematic view illustrating the present apparatus after the apparatus has been run into the well, the packer being anchored and set against the casing and each of the valves being in closed position.
Figure 1B:
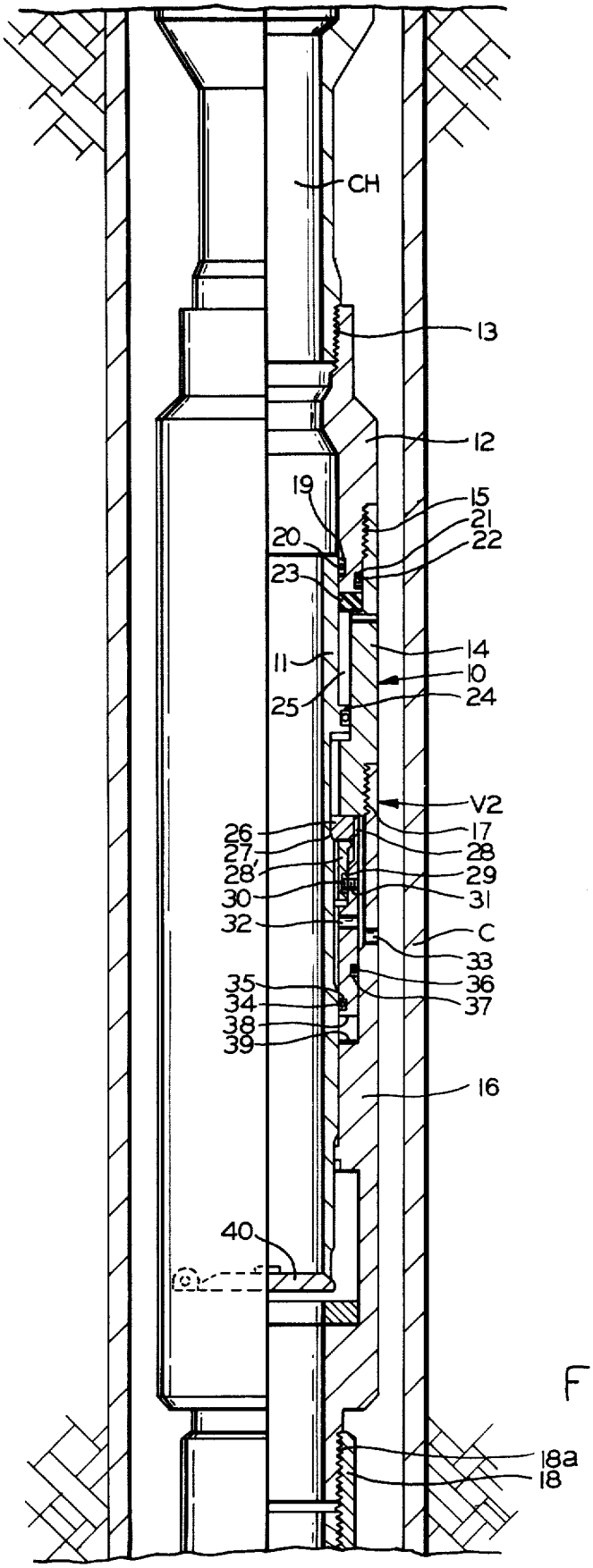
Figure 1C:
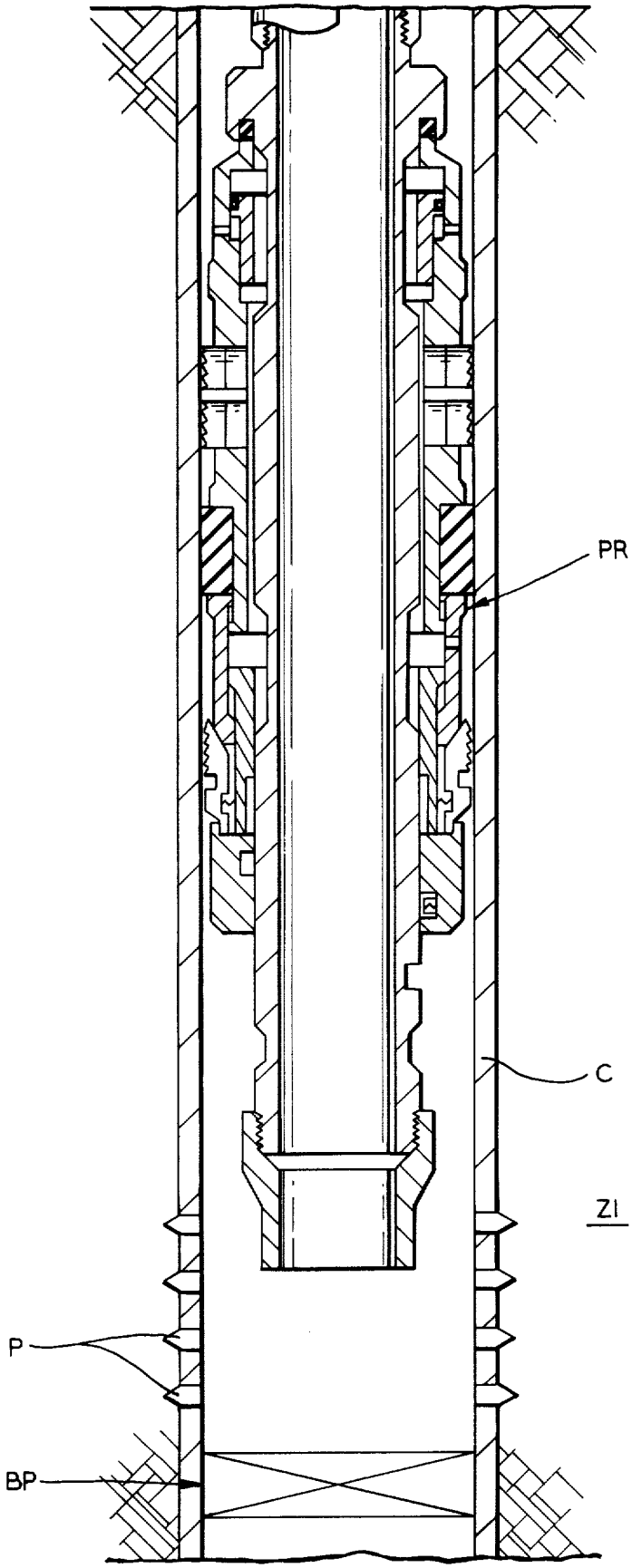

Referring now to FIGS. 1A, 1B and 1C, a tubing string TS is lowered into a well bore having a casing C. The tubing string TS carries an upper valve assembly V1 and a lower valve assembly V2, the valve assemblies V1 and V2 being separated by an atmospheric pressure chamber CH. The tubing string TS is terminated at its lower end by a conventional packer assembly PR which is designed to hold pressure from above and below when set. The tubing string is run into the well, and the packer PR landed immediate a bridge plug BP within the bore of the well and above perforations P which communicate with production zone Z1.

Figure 2A:
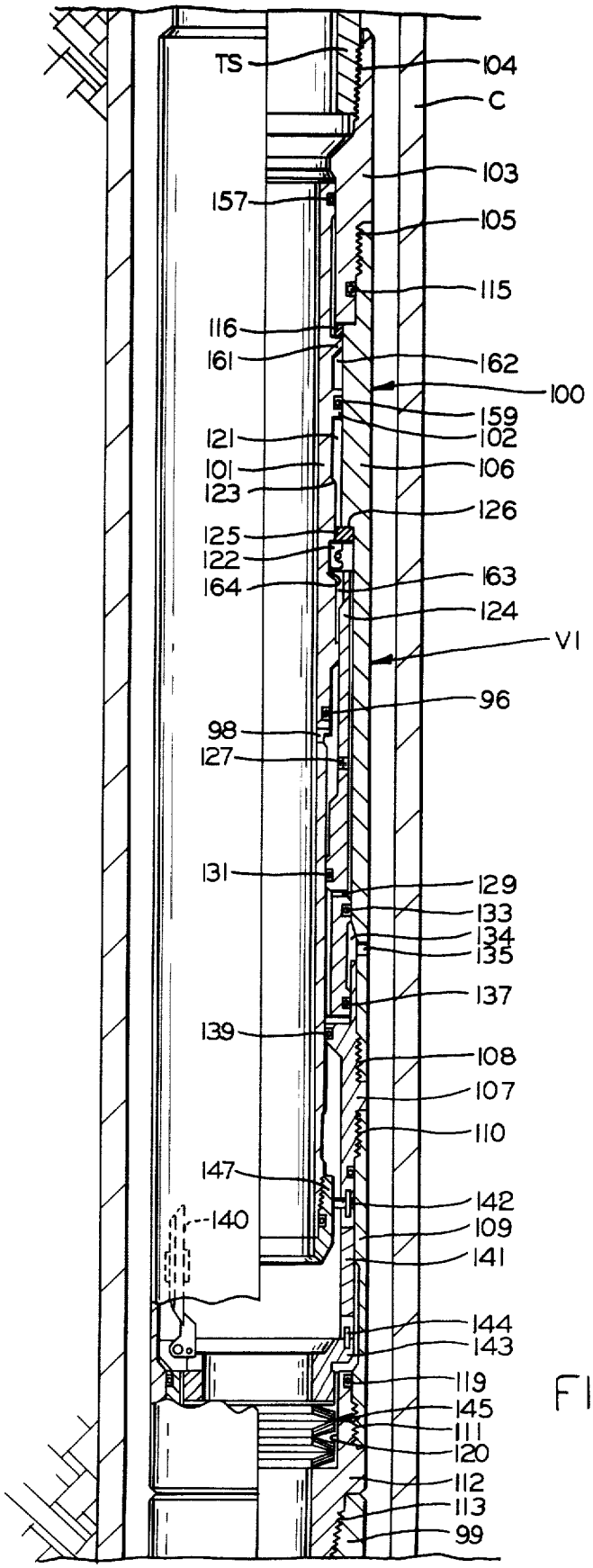
FIGS. 2A, 2B and 2C are similar to the views illustrated in FIGS. 1A, 1B and 1C, showing each of the upper and lower valves in open position with circulation being initiated to clean out the well bore subsequent to the cleaning operation, the packer being released from the casing.
Figure 2B:
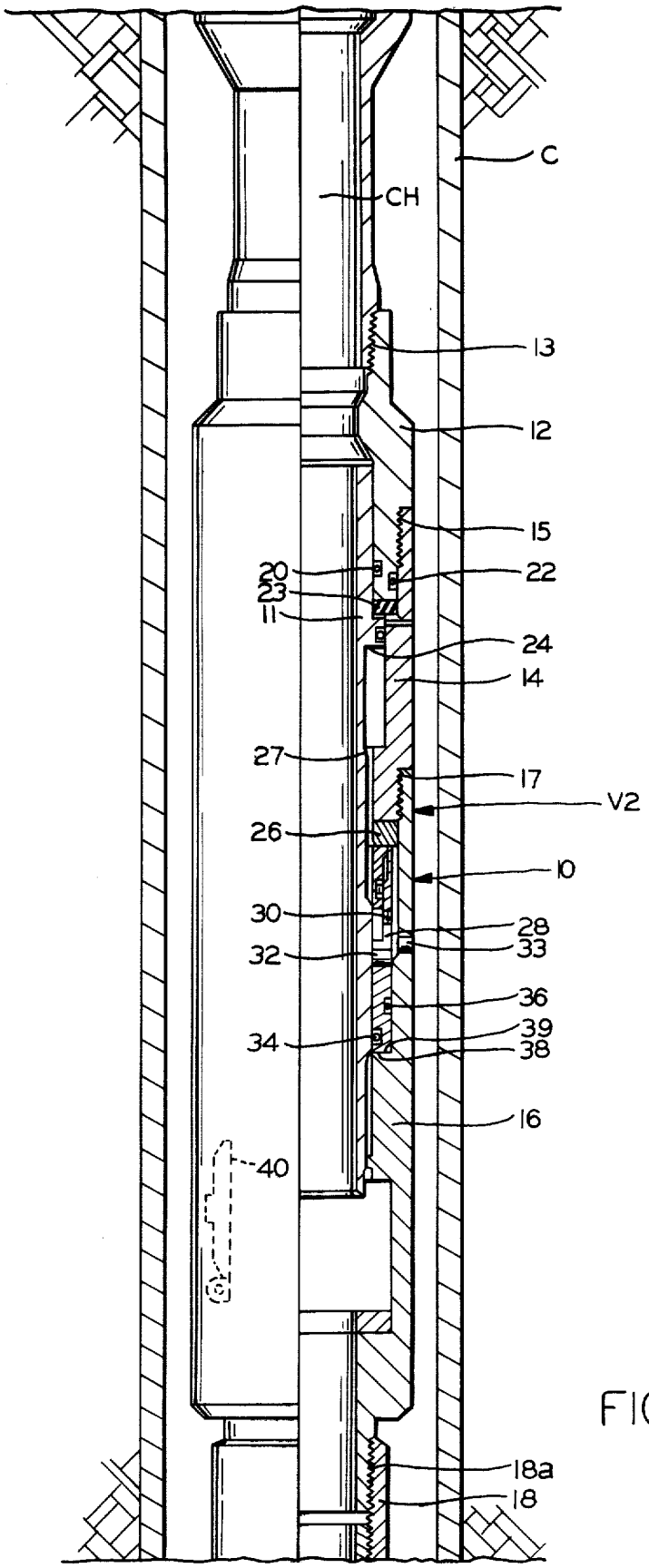
Figure 2C:
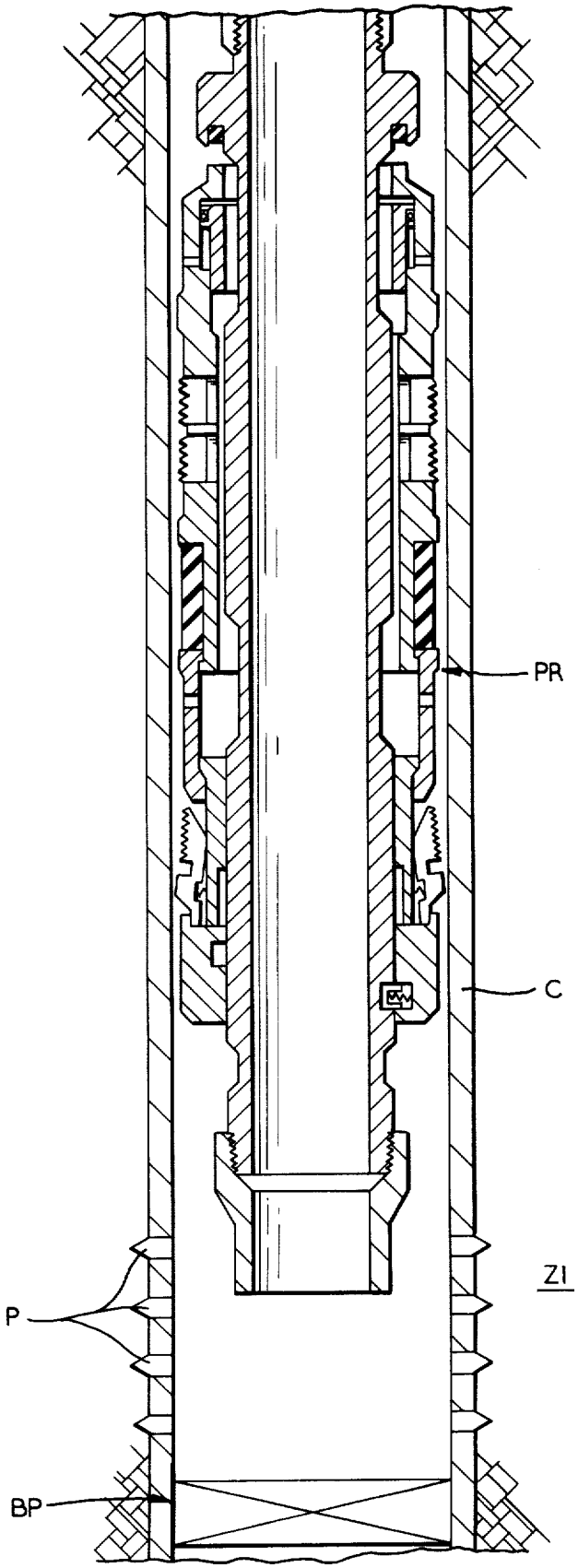

As particularly illustrated in FIGS. 1B and 2B, the lower valve assembly V2 is essentially the same as that described in U.S. Pat. No. 4,185,690. Such assembly includes an outer longitudinally extending housing 10 containing an axially extended annular piston mandrel 11 therein. The housing 10 is defined at its uppermost end by a top sub 12 which is secured by threads 13 to the lowermost tubular section forming the pressure chamber CH thereabove. The outer housing 10 also includes an annular piston housing 14 which is secured by threads 15 to the top sub 12. The bottom portion of outer housing 10 comprises an annular valve housing 16 which is secured to the piston housing 14 by threads 17. The lower end of valve housing 16 is secured by threads **18*a* to an internally threaded sleeve 18** which in turn is threadably connected to the upper end of the packer PR.

The top sub 12 in addition to having threads 15 defined thereon for securement to the piston housing 14 therebelow, also has an interior circumferentially extending grooveway 19 for housing an elastomeric ring element 20 to prevent fluid communication between the top sub 12 and the piston mandrel 11. A similar grooveway 21 and ring element 22 is also defined on the exterior of top sub 12 to prevent fluid communication between the top sub 12 and the piston housing 14. An elastomeric spacer or shock absorber 23 is carried by the top sub 12 at its lowermost end and defines the limit of upward travel of a piston head 24 carried by the piston mandrel 11 as the valve assembly V2 is manipulated to open position.

The annular piston housing 14 has a smooth cylindrical inner wall 25 for slidable longitudinal movement of the piston head 24 thereon as the valve V2 is manipulated to open position. Somewhat below the inner wall 25, and immediately interior of the valve housing 16, is a series of inwardly contracted ring segments 26 having their inner faces resting on a shoulder 27 on the piston mandrel 11. The ring segments 26 are shearably secured to a longitudinally extending segment retainer sleeve 28 carried within the outer housing 10 between the valve housing 16 and the piston mandrel 11, the segments 26 being secured to the retainer 28 by means of a guard 28'. The guard 28' receives within a groove 29 thereof a shear screw 30 which is inserted through the segment retainer 28 by means of a threaded bore 31. When the segments 26 shoulder upon the shoulder 27 of the piston mandrel 11, the upper longitudinal end of the segment retainer sleeve 28 is positioned upwardly and over the segments 26 and contacts the lower end of the piston housing 14. With the shear screw 30 engaging the guard 28', the segments 26 are urged interiorly of the segment retainer 28 such that a beveled shoulder on the piston mandrel 11 contacts and shoulders upon a compansion stop on the segments so that upward longitudinal movement of the piston mandrel 11 is arrested. When in engaged position, the outer face of the ring segment 26 is interfaced with the upper end of the segment retainer 28.

The segment retainer 28, normally locked interior of the housing 16 as described above, contains a radial port 32 defined thereacross which is always in communication with companion port 33 in the housing 16, the ports 32 and 33 communicating with the annular area between the casing C and the outer housing 10 to permit annulus pressure to selectively act upon the piston head 24 and the segment retainer 28 when it is desired to manipulate the valve V2 to open position.

An elastomeric O-ring 34 contained within a groove 35 on the lowermost end of the segment retainer 28 prevents fluid communication between the piston mandrel 11 and the segment retainer 28 while a similar O-ring 36 contained within its groove or boreway 37 on the segment retainer 28 prevents fluid communication between the retainer 28 and the housing 16.

The lowermost end 38 of the segment retainer 28 will, upon application of fluid pressure upon the segment retainer 28 and the piston head 24, shift the segement retainer 28 longitudinally downwardly until such time as the lower end thereof rests upon an upwardly facing companion shoulder 39 on the housing 16.

The valve housing 16 contains a flapper-type valve assembly which normally is maintained closed by the piston mandrel 11 as shown in FIG. 1B. The flapper valve assembly consists of flapper head 40 which, when in closed position, completely bridges the internal diameter of the bore of the outer housing 10 near the bottom of the valve housing 16.

The structure and operation of the lower valve assembly V2 is described in detail in U.S. Pat. No. 4,185,690, and further discussion thereof is not necessary.

Referring now to FIGS. 1A, 2A, 3 and 4, the upper valve assembly V1 basically consists of an annular outer housing 100 enclosing a longitudinally elongated actuating sleeve 101 having a radially projecting piston head 102 integral therewith. The outer housing 100 includes a top sub 103 at its uppermost end, which is secured by threads 104 to the lower end of the tubing strings TS. The top sub 103 is secured by threads 105 to the top end of an upper cylindrical piston housing 106. The bottom end of the piston housing 106 is secured by threads 108 to a connector element 107. The outer housing 100 is terminated at its lowermost end by a valve housing 109 which is secured to the connector 107 by means of threads 110. The valve housing 109 is secured by means of threads 111 to a bottom sub 112 which is secured by threads 113 to the uppermost tubular section 99 forming the atmospheric chamber CH therebelow.

The top sub 103 has an exterior circumferentially extending grooveway 114 for housing of an elastomeric O-ring 115 to prevent fluid communication between the top sub 103 and the piston housing 106. An elastomeric spacer or shock absorber 116 abuts the bottom end of the top sub 103 and defines the limit of upward travel of the piston head 102 carried by the actuating sleeve 101 as the valve V1 is manipulated into its open position. Further, the top sub 103 has a smooth inner wall 117 which slidably cooperates with the uppermost end of the actuating sleeve 101 as the valve V1 is manipulated into open position.

The upper annular piston housing 106 has a smooth inner wall 121 for slidably cooperating with the piston head 102 carried by the actuating sleeve 101 as the valve V1 is manipulated into open position. Somewhat below the inner wall 121 and immediately interior of the upper housing 106 is a series of inwardly contracted ring segments 122 having their bottom faces resting upon a shoulder 123 on the actuating sleeve 101. The segments 122 are secured in such position by the top end of an axially movable segment retainer sleeve 124 carried within the outer housing 100 between the upper piston housing 106 and the actuating sleeve 101. When the segments 122 engage the shoulder 123 of the actuating sleeve 101, the upper longitudinal end of the retainer sleeve 124 surrounds the segments 122 and contacts the lower surface of a segment stop ring 125 seated against a shoulder 126 defining the lower end of the inner housing wall 121.

Somewhat below the ring segments 122, the retainer sleeve 124 is provided with a number of circumferentially spaced shear screws 127 (only one shown). The shear screws 127 project inwardly of the retainer sleeve and overlie a shoulder 128 on the actuating sleeve 101.

A transversely extending port 129 is provided through the wall of the retainer sleeve 124, the purpose of which will be described hereinafter. Above the port 129, the retainer sleeve 124 has an interior circumferential grooveway 130 for housing an elastomeric O-ring 131 to prevent fluid communication between the sleeve 124 and the actuating sleeve 101. A similar exterior grooveway 132 and O-ring 133 also are defined on the sleeve 124 below the port 129 to prevent fluid communication between the sleeve 124 and the upper housing 106. Above O-ring 131, a plurality of radial ports 98 are formed in the wall of actuating sleeve 101. An exterior peripheral groove 97 in the actuating sleeve 101 and an O-ring 96 prevent fluid leakage between retainer sleeve 124 and actuating sleeve 101.

The lowermost end of the retainer sleeve 124, together with the upper housing 106 and the connector 107 define a chamber 134 therebetween communicating with the annular area between the outer housing 100 and the casing C through a port 135 in the upper housing 106. Thus, the chamber 134 is vented for permitting the retainer sleeve 124 to be moved by the application of tubing pressure. Also, the lowermost end of the retainer sleeve 124 has an exterior circumferential grooveway 136 for housing an elastomeric O-ring 137 to prevent fluid communication between the connector 107 and the sleeve 124.

Somewhat below the uppermost end of the connector 107, the connector has an interior circumferential grooveway 138 for housing an elastomeric O-ring 139 to prevent fluid communication between the actuating sleeve 101 and the outer housing 100.

The bottom sub 112 has an exterior circumferentially extending grooveway 118 for housing of an elastomeric O-ring 119 to prevent fluid communication between the bottom sub 112 and the valve housing 109. The bottom sub 112 is also provided with a counterbore 120, the purpose of which will be described hereinafter.

The valve assembly V1 contains a flapper-type valve 140 which normally is maintained closed by the bottom end of a cup element 147. This valve 140 may be frangibly constructed so that the head may be pierced to open it in emergency situations, by means of a wireline tool, a rod, or the like. The flapper valve, when in closed position, completely bridges the interior of the outer housing 100. More specifically, the lowermost end of the connector 107 carries a spacer sleeve 141 by means of a drive lock pin 142, and the lowermost end of the spacer sleeve carries a locator ring 143 by means of the drive lock pin 144. The locator ring 143 pivotally mounts the flapper valve 140. The locator ring 143 is urged upwardly by a stack 145 of Belleville spring washers 146 disposed in the counterbore 120 of the bottom sub 112 against the bottom face of the locator ring 143, for urging the flapper valve 140 to a sealed position, as best illustrated in FIG. 3.

Figure 3:
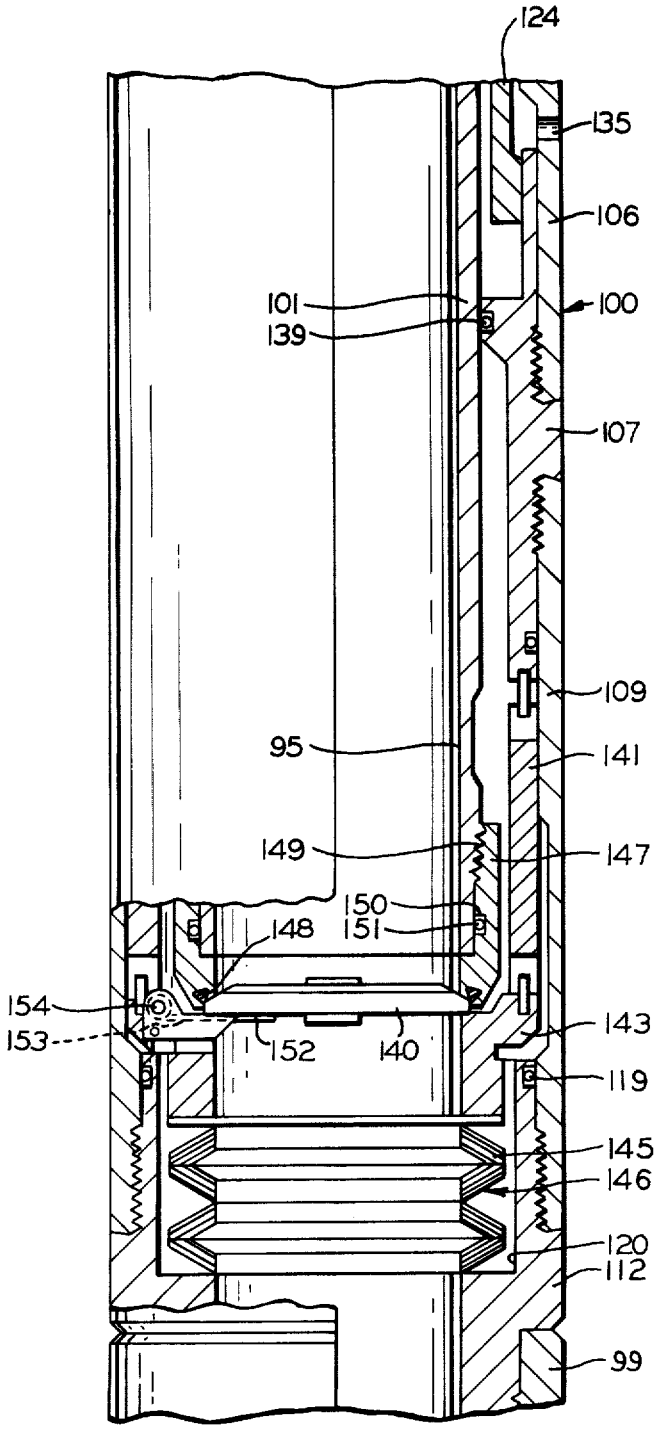
FIG. 3 is an enlarged sectional view of the upper valve assembly in closed position prior to the initiation of circulation.
Figure 4:
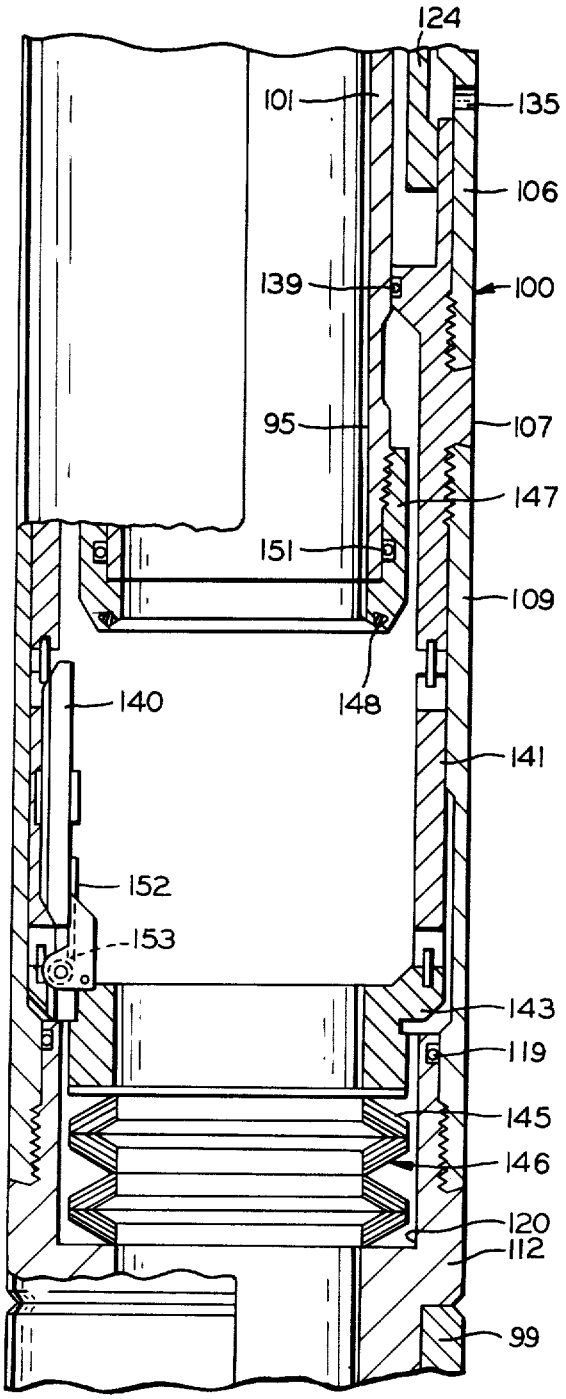
FIG. 4 is an enlarged sectional view illustrating the upper valve assembly in its open position.

Referring now to FIGS. 3 and 4, a cup element 147 having a seal ring or valve seat 148 is carried on the lowermost end of the actuating sleeve 101 by threads 149. Valve seat 148 securely seals the flapper valve 140 with respect to the bore 95 of the actuating sleeve 101 when the flapper valve 140 is in the closed position bridging the interior of the outer housing 100. The cup element 147 has an interior circumferential grooveway 150 for housing an elastomeric O-ring 151 to prevent fluid communication between the actuating sleeve 101 and the cup element 147.

Referring particularly to FIGS. 3 and 4, one leg 152 of a torsion spring 153 contacts the lower side of the flapper valve 140 and is carried around a hinge pin 154 within the locator ring 143 to urge and shift the flapper valve 140 upwardly away from the locator ring 143 when the valve V1 is manipulated to open position, as shown in FIG. 4, such that the flapper valve is fully open with respect to the interior of the housing 100 of the valve assembly V1. A spring-loaded retainer pin may be carried within the locator ring 143 and is shifted to locked position within the ring 143 when the flapper valve 140 is shifted to open position to prevent inadvertent movement of the flapper valve 140 towards the "Closed" position as the result of pressure surges, or the like.

As previously indicated, the actuating sleeve 101 is carried within the outer housing 100 and its piston head 102 is permitted to slide longitudinally along the smooth inner wall 121 of the upper valve housing 106 as the valve V1 is manipulated to open position. A circumferentially extending elastomeric O-ring 157 is contained within an external peripheral grooveway 158 on the uppermost end of the actuating sleeve 101 to prevent fluid communication between the top sub 103 and the actuating sleeve 101 as it slides along the smooth bore wall 117 of the top sub 103. A circumferentially extending elastomeric O-ring 159 is contained in an external peripheral grooveway 160 on the piston head 102 to prevent fluid communication between each opposed side of the piston head 102 as it slides along the smooth bore wall 121 of the outer housing 106. As the actuating sleeve is shifted upwardly toward the top sub 103 as the valve V1 is manipulated to the open position, the upper face of a shoulder 161 integrally formed on the sleeve 101 will encounter the lower face of the shock absorber 116 which defines the upper limit of longitudinal travel of the actuating sleeve 101.

It should be noted that an upper atmospheric chamber 162 is defined between the outer housing 106 and the actuating sleeve 101, between the upper O-ring 157 carried by the actuating sleeve and the O-ring 159 carried by the piston head 102 of the actuating sleeve 101 and the ring 115. Similarly, a lower atmospheric chamber 163 is defined between the bore of the outer housing 106 and the actuating sleeve 101, between the O-ring 159 carried by the piston head 102 and the O-ring 139 located in the connector 107, together with rings 137, 132 and 131.

The valve assembly V1 is normally closed as illustrated in FIGS. 1A and 3, and locked in this position by the ring segments 122 as previously described. The valve assembly V1 is opened by pressurizing the tubing pressure sufficiently to shear the shear screws 127. The tubing pressure acting on the segment retainer sleeve 124 through the port 98 will move the retainer sleeve 124 downwardly, releasing the ring segments 122 to move outwardly and dumping tubing pressure into the lower chamber 163. Tubing pressure acting on the lower face of piston head 102 will move the actuating sleeve 101 upwardly until the shoulder 161 bottoms out on the shock absorber 116. The ring segments 122 will then drop into a lower circumferentially extending groove 164 on the actuating sleeve 101, locking the actuating sleeve in an open position.

It should be noted that the seal on the flapper valve 140 is broken as soon as the actuating sleeve 101 begins to move and the torsion spring 153 will move the flapper valve 140 upwardly to its open position as illustrated in FIG. 4.

If for any reason the flapper valve 140 fails to open or does not open completely, the valve 140 is preferably manufactured from a frangible material and easily broken out by use of an auxiliary tool (not shown).

OPERATION

When it is desired to clean debris from the perforations P and the formation face within the zone Z1 the backsurge apparatus of the present invention is run in the well on tubing string TS. The valve assembly V1, being affixed to the tubing string TS, is carried down into the well in its closed position as shown in FIGS. 1A and 3. A series of the tubular sections are carried below the valve assembly V1 to define the atmospheric surge chamber CH.

The lower valve assembly V2 is secured below the lowermost tubular section forming the surge chamber CH, the valve assembly V2 being in closed position. The packer PR is affixed to the lowermost end of the valve assembly V2.

Referring now to FIGS. 1A, 1B, and 1C, the assembly is carried into the well and the lower end of the packer PR is located above the perforations P. Thereafter, the packer PR is set above the zone Z1. Thereafter, the valve assembly V2 is manipulated to open position thus implosionly exposing the zone Z1 to the atmospheric chamber CH.

When it is desired to manipulate the flapper head 40 of the valve assembly V2 to open position to connect the production zone Z1 and the perforations P with the low pressure surge chamber CH, pressure within the annulus between the casing C and the tubing string TS is increased. The increased pressure passes through the outer housing 10 by means of the port 33 within the valve housing 16, thence through the port 32 within the segment retainer 28.

It should be noted that since the effective piston areas across the piston head 24 and the ring 34 in the segment retainer 28 are equal, pressure will act upon each of these piston areas simultaneously. However, the segment retainer 28 and the piston mandrel 11 will not move with respect to one another until such time as the increased annulus pressure causes the shearing of the shear screws 30. When the shear screws 30 are sheared, the segment retainer 28 will be urged downwardly until its lower end 38 is shouldered upon the shoulder 37 of the valve housing 16. In this shifted position, the upper end of the segment retainer 28 has passed below the lower end of the segments 26, and the segments 26 are now free to expand outwardly and away from the piston mandrel 11, thus freeing the piston mandrel 11 to travel longitudinally upwardly. Accordingly, as annulus pressure is increased and transmitted through the ports 32 and 33, pressure will continue to act upon the piston head 24 until its upper end rests upon the lower face of the shock absorber 23. Now, correspondingly, the piston mandrel 11 has been shifted to the up position, releasing the flapper head 40 from its engaged or closed position. As the flapper head 40 is manipulated to open position, the piston mandrel 11 is shifted upwardly, pressure within the chamber CH and pressure immediate the zone Z1 and below the chamber CH will begin to equalize, thus providing a vacuum-like action upon the perforation surfaces to draw a surge of fluid therethrough to remove particulate matter from perforations P and formation Z1.

After the pressure has been equalized between the zone Z1 and the chamber CH and debris and contaminant removed from the surface of the perforations P, reverse circulation may be initiated after manipulating the upper valve assembly V1 to open position.

When it is desired to open the upper valve assembly V1 to, for example, provide a complete passage for reverse circulation to clean the well after the zone Z1 and the perforations P have been exposed to the chamber CH, pressure within the tubing string TS is increased and is transmitted through the port 98. As pressure is increased, the strength of the shear pins 127 will be overcome and the pins 127 will shear, thus enabling the increased pressure to act upon the piston head 102 and shift the piston head 102 and actuating sleeve 101 longitudinally upward until the upper face of the shoulder 161 contacts the lower face of the elastomeric shock absorber 116, whereby further upward longitudinal movement is prevented. As the actuating sleeve 101 is shifted upwardly, the segments 122 and the groove 164 will come in latitudinal alignment and the segments 122 will contract into locking engagement with the groove 164 and prevent reverse downward longitudinal movement of the actuating sleeve 101. As the actuating sleeve 101 is shifted longitudinally upward, the port 98 will dump pressure into the chamber 163. Since the passage through the valve V1 is always in communicating with the interior of the chamber CH, the interior of the valve assembly V2, the interior of the packer PR and the internal diameter of the casing C immediate the perforations P, the zone Z1 may be placed in fluid communication with the tubing string TS to the top of the well by pulling the tubing string TS to release the packer PR from its sealed engagement with the casing C. Reverse circulation may be initiated by pumping fluid down the casing annulus, around the packer PR and into the valve assemblies V1 and V2 and to the top of the well through the tubing string TS.

After the remedial operation has been conducted, the tubing string TS and the backsurge apparatus are removed from the well and production may be initiated through a production string or the like.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a surging apparatus for cleaning particulates from the perforations or the production formation face of a subterranean well, the apparatus including a surge chamber connectable to a tubing string and insertable in the well casing at atmospheric pressure, and a pressure actuated lower valve positionable between the lower end of the atmospheric pressure surge chamber and the casing bore adjacent to the casing perforations, said pressure operated lower valve being actuated by a predetermined increase in the fluid pressure in the annulus between the casing and the tubing string, the improvement comprising: a packer apparatus carried on said tubing string for selective sealing engagement at a predeterminable position in the well; a flapper valve pivotally mounted in the tubing string above the atmospheric pressure surge chamber and normally closing the bore of the tubing string; an axially shiftable actuating sleeve normally engaging the perimeter of said flapper valve to maintain same in a closed position with respect to the bore of the tubing string; radially shiftable locking means normally securing said actuating sleeve in said valve closing position; a retainer sleeve normally holding said locking means in said normal locking position, said retainer sleeve having a lower end disposed in a fluid pressure chamber communicable with the bore of the tubing string; shear means preventing movement of said retaining sleeve from its normal locking position with respect to the locking means, whereby an increase in fluid pressure in said tubing string bore above a predetermined level effects the shearing of said shear means and the axial movement of said retainer sleeve to release said locking means; a piston shoulder on said actuating sleeve exposed to fluid pressure in the tubing string bore by the pressure induced movement of said retainer sleeve to effect the shifting of said actuating sleeve to an unlocked position relative to said flapper valve; and biasing means for urging said flapper valve to its open position.

2. The valve apparatus of claim 1 wherein said flapper valve is a frangible member.

3. The apparatus of claim 1 wherein a valve housing surrounds said actuating sleeve, said piston shoulder being longitudinally slidable within said housing, a first atmospheric pressure chamber in said housing located on one side of said piston shoulder, a second atmospheric pressure chamber in said housing located on the other side of said piston shoulder and means operable by axial movement of said retainer sleeve for establishing fluid communication between the tubing string bore and said second chamber.

4. The apparatus of claim 1 wherein the bottom end of said actuating sleeve carries a seat for said flapper valve.

5. The apparatus of claim 4 wherein said flapper valve is pivotally mounted on an axially shiftable ring and resilient means are provided to urge said ring in the direction to force said flapper valve into sealing engagement with said bottom end of the actuating sleeve.

6. A pressure actuated valve for incorporation in a subterranean well conduit, comprising: an elongated annular housing; an actuating sleeve slidably mounted in said housing; a frangible flapper valve; means for pivotally mounting said flapper valve in said housing in a position to close the bore of said actuating sleeve by sealing engagement of the perimeter of said flapper valve with the bottom end of said actuating sleeve; radially shiftable locking means normally securing said actuating sleeve in a valve closing position; a retainer sleeve normally holding said locking menas in said normal locking position, said retaining sleeve having an annular piston portion thereof disposed in a fluid pressure chamber defined by said housing and having a fluid connection to the bore of said housing; separatable means preventing movement of said retaining sleeve from its said normal locking position with respect to the locking means, whereby an increase in fluid pressure in said conduit above a predetermined level effects the separation of said separatable means and the axial movement of said retainer sleeve to release said locking means; a piston shoulder on said actuating sleeve exposed to fluid pressure in the housing bore by the pressure induced movement of said retainer sleeve to effect the shifting of said actuating sleeve to an unlocked position relative to said flapper valve; and biasing spring means for urging said flapper valve to its open position.

7. The apparatus of claim 6 wherein said housing defines a first atmospheric pressure chamber located on one side of said piston shoulder and a second atmospheric pressure chamber located on the other side of said piston shoulder, and means operable by axial movement of said retainer sleeve for establishing fluid communication between the bore of said housing and said second chamber.

8. The apparatus of claim 6 wherein said flapper valve is pivotally mounted on an axially shiftable element and resilient means are provided to urge said shiftable element in the direction to force said flapper valve into sealing engagement with said bottom end of the actuating sleeve.

* * * * *